US006496148B2

(12) United States Patent
Ngounou Kouam et al.

(10) Patent No.: US 6,496,148 B2
(45) Date of Patent: Dec. 17, 2002

(54) ANTENNA WITH A CONDUCTIVE LAYER AND A TWO-BAND TRANSMITTER INCLUDING THE ANTENNA

(75) Inventors: Charles Ngounou Kouam, Les Ulis (FR); Jean-Philippe Coupez, Brest (FR)

(73) Assignee: Alcatel, Paris (FR)

( * ) Notice: Subject to any disclaimer, the term of this patent is extended or adjusted under 35 U.S.C. 154(b) by 0 days.

(21) Appl. No.: 09/897,467

(22) Filed: Jul. 3, 2001

(65) Prior Publication Data

US 2002/0003499 A1 Jan. 10, 2002

(30) Foreign Application Priority Data

Jul. 10, 2000 (FR) ..... 00 08964

(51) Int. Cl.[7] ..... H01Q 1/38
(52) U.S. Cl. ..... 343/700 MS; 343/846
(58) Field of Search ..... 343/700 MS, 702, 343/846; H01Q 1/38

(56) References Cited

U.S. PATENT DOCUMENTS 4,692,769 A 9/1987 Gegan
4,766,440 A 8/1988 Gegan ..... 343/700 MS
4,771,291 A 9/1988 Lo et al.
6,121,930 A * 9/2000 Grangeat et al. .... 343/700 MS
6,133,879 A * 10/2000 Grangeat et al. .... 343/700 MS
6,218,990 B1 * 4/2001 Grangeat et al. .... 343/700 MS
6,255,994 B1 * 7/2001 Saito ..... 343/700 MS

FOREIGN PATENT DOCUMENTS

EP 0 923 156 A1 6/1999
GB 2 288 284 A 10/1995

OTHER PUBLICATIONS

Dual Band Cavity–Backed Quarter–Wave Patch Antenna Amir Boag, Yuval Shimony, Alona Boag, and Raj Mittra Electromagnetic Communication Laboratory, University of Illinois, Urbana, IL 61801, pp. 2124–2127.

* cited by examiner

*Primary Examiner*—Hoanganh Le
(74) *Attorney, Agent, or Firm*—Sughrue Mion, PLLC

(57) ABSTRACT

The antenna of said transmitter is a microstrip antenna. A rear edge of its patch is provided with a short circuit by means of which a quarter-wave primary resonance can be excited by a coplanar line formed by two coupling slots in an area. Separator slots separate said area from another area in which a secondary resonance can be established at twice the frequency of the primary resonance from a slotted line extending one slot of the coplanar line. The invention applies in particular to the production of a dual-mode mobile telephone to the GSM and DCS standards.

12 Claims, 2 Drawing Sheets

ANTENNA WITH A CONDUCTIVE LAYER AND A TWO-BAND TRANSMITTER INCLUDING THE ANTENNA

The present invention relates generally to radio transmitters, in particular mobile telephones, and more particularly to antennas for inclusion in such transmitters and including a conductive layer.

BACKGROUND OF THE INVENTION

This kind of antenna includes a patch which is typically obtained by etching a metal layer. It is then called a microstrip patch antenna.

The microstrip technique is a planar technique that is used to make transmission lines for transmitting guided waves, possibly carrying signals, and antennas coupling such lines and radiated waves. It uses conductive patches and/or strips formed on the top surface of a thin dielectric substrate. A conductive layer extends over the bottom surface of the substrate and constitutes an earth layer of the line or the antenna. The patch is typically wider than the strip and its shape and dimensions are important characteristics of the antenna. The substrate is typically a plane rectangular sheet of constant thickness and the patch is also typically rectangular. This is not obligatory, however. In particular, it is known in the art that varying the thickness of the substrate can enlarge the bandwidth of this kind of antenna and that the patch can be various shapes, for example circular. The electric field lines extend between the strip or the patch and the earth layer through the substrate. A transmission line operating in the above manner is referred to hereinafter as a microstrip line.

The above technology differs from coplanar technologies that also use conductive elements on a thin substrate, and in particular the transmission line technology in which the electric field is established on the top surface of the substrate and symmetrically between a central conductive strip and two conductive lands on respective opposite sides of the strip, from which they are separated by respective slots. A transmission line operating in this manner is referred to hereinafter as a coplanar line. In an antenna using this technology, a patch is surrounded by a continuous conductive land from which it is separated by a slot.

In another coplanar technology, a transmission line is formed by a slot in a conductive layer and the electric field of the transmitted wave is established in the plane of that layer between the two edges of the slot.

Antennas using the above technologies typically (although not necessarily) constitute resonant structures in which standing waves are established that provide coupling with waves radiated in space.

Various resonant structures of the above kind can be made, for example using the microstrip technology, and each such structure can support one or more resonant modes, referred to for brevity hereinafter as "resonances". Broadly speaking, each resonance can be defined as a standing wave formed by the superposition of two travelling waves propagating along the same path in opposite directions and resulting from alternating reflection at the two ends of the path of the same travelling wave, which is an electromagnetic wave propagating along that path in a line consisting of the earth layer, the substrate and the patch, for example. The path is imposed by the components of the antenna. It can be rectilinear or curved. It is referred to hereinafter as the "resonance path". The resonant frequency is inversely proportional to the time taken by the travelling wave referred to above to travel this path.

In a first type of resonance, which is referred to as "half-wave" resonance, the length of the resonance path is typically substantially equal to one half-wavelength, i.e. to half the wavelength of the travelling wave referred to above. The antenna is then referred to as a ""half-wave" antenna. This type of resonance can be generally defined by the presence of an electrical current node at each of the two ends of a path of this kind, whose length can therefore also be equal to said half-wavelength multiplied by an integer other than one, and typically an odd number. The two ends of the path are located in regions in which the amplitude of the electrical field that is applied via the substrate, for example, is at a maximum; coupling with the radiated waves occurs at one or both ends of the path.

A second type of resonance that can be obtained using the same technology is referred to as "quarter-wave" resonance and differs from half-wave resonance firstly in that the resonance path typically has a length equal to one quarter-wavelength, i.e. one quarter of the wavelength defined above. To this end the resonant structure must include a short circuit at one end of the path, the term "short circuit" referring to a connection between the earth layer and the patch. The short circuit must have a sufficiently low impedance to impose the resonance. This type of resonance can be generally defined by the presence of an electric field node fixed by this kind of short circuit in the vicinity of an edge of the patch and by an electrical current node at the other end of the resonance path. The length of the resonance path can therefore be equal to an integer number of half-wavelengths added to said quarter-wavelength. Coupling with waves radiated in space occurs at an edge of the patch, in a region where the amplitude of the electric field is sufficiently high.

Other types of resonance can be established, each characterized by a distribution of the electric and magnetic fields that oscillate in an area of space including the antenna and its immediate vicinity. They depend in particular on the configuration of the patches, which can incorporate slots, possibly radiating slots. In the case of microstrip antennas, the resonances are also conditioned by the presence and location of any short circuits and by the electrical models representing the short circuits if the latter are imperfect, i.e. if they cannot be considered even approximately equivalent to perfect short circuits of zero impedance.

The presence of an imperfect short circuit in an antenna can cause a resonance having what is referred to as a virtual node, which occurs when the following conditions are met (in what follows, the antenna discussed above is referred to as the "first antenna"):

- The distribution of fields in the first antenna is substantially identical to a distribution that can be induced in an identical area of the patch of a second antenna.
- The second antenna is identical to the first antenna, within the limits of the area, except that the second antenna has no short circuit.
- The patch of the second antenna extends not only over the area already mentioned, which then constitutes a principal area of the second antenna, but also over an additional area.
- Finally, the field distribution in question in the principal area of the second antenna is accompanied by an electric or magnetic field node in the additional area.

In order to describe the resonance occurring in the first antenna, the node occurring in the second antenna can be considered to constitute a node for the resonance of the first antenna also. For an antenna such as the first antenna this kind of node is referred to hereinafter as a "virtual" node, because it is located in an area outside the patch of the antenna and in which there is therefore no electric or magnetic field enabling the presence of the node to be determined directly.

Although these "virtual nodes" are not conventionally taken into account in those terms when describing resonances, they are implied by the distinction that is sometimes made between the physical or geometrical length of the patch and its so-called "electrical" length. In the case of the two antennas considered above, the physical or geometrical length of the patch of the first antenna would be that of the patch, but the electrical length of the patch would in fact be the physical or geometrical length of the patch of the second antenna.

An antenna is typically coupled to a signal processor such as a transmitter by a connection system including a connection line which is external to the antenna and terminates in a coupling system integrated into the antenna for coupling the line to one or more resonances that can be established in one or more resonant structures of the antenna. The resonances also depend on the nature and location of the connection system, which enables the antenna to be used at each resonant frequency. In the case of a transmit antenna, the connection system is often referred to as a feed line of the antenna.

The present invention concerns various types of device, such as mobile telephones, base stations for mobile telephones, vehicles, aircraft and missiles. In the case of a mobile telephone, the continuous nature of the bottom earth layer of a microstrip antenna facilitates limiting the amount of radiated power that is intercepted by the user's body. In the case of vehicles, and above all in the case of aircraft or missiles, whose exterior surface is metallic and has a curved profile to produce a low aerodynamic drag, the antenna can be conformed to that profile so that no unwanted additional aerodynamic drag is produced.

The invention relates more particularly to the situation in which an antenna with a conductive layer must have the following qualities:

- it must be able to transmit and/or receive radiated waves efficiently on two separate frequencies with a large difference between them,
- it must be possible to connect it to a signal processor by means of a single connecting line for all operating frequencies of a transmission device without causing an unwanted spurious standing wave ratio on the line, and
- it must achieve this without using a frequency multiplexer or demultiplexer.

Many prior art microstrip antennas with the above three qualities have been made or proposed. They differ in terms of how they establish and couple a plurality of different resonant frequencies. Several such antennas are examined below.

A first such prior art antenna is described in U.S. Pat. No. 4,692,769 (Gegan). In a first embodiment, the patch of the antenna takes the form of a circular disk 10 enabling the antenna to exhibit two half-wave resonances whose paths are respectively established along a diameter AA of the disk and along a circular arc slot 24 inscribed in the disk. The coupling system takes the form of a line 16 constituting a quarter-wave transformer and connected at an interior point to the area of the patch so that the real part of the input impedance of the antenna has substantially the same value for the two resonances. Impedance-matching slots 26 and 28 are concentrically inscribed in the disk 10 so that the imaginary part of the input impedance also has substantially the same value for the two resonances. The line 16 is a microstrip line. In other words, it is not made using the coplanar line technology described hereinabove. However, the document also states that the line is coplanar, but this merely indicates that the strip of the microstrip line is in the same plane as the patch 10. Two slots are formed in the conductive layer of the patch, one on each side of the strip, to enable a terminal segment of the line to penetrate into the area of the patch without causing unwanted contact of the strip with the patch in that segment. One of the two slots is continued by an extension that constitutes the impedance-matching slot 28, and so the line 16 appears to exhibit asymmetry at the end inside the patch 10. Despite the apparent continuity and asymmetry, the skilled person will realize that in practice no wave propagates over the length of the impedance-matching slot 28.

A second prior art antenna is described in U.S. Pat. No. 4,766,440 (Gegan). The general shape of the patch 10 of this antenna is rectangular, enabling the antenna to exhibit two half-wave resonances whose paths are established along a length and a width of the patch. It also features a U-shaped curved slot which is entirely inside the patch. The slot is a radiating slot and establishes an additional resonance mode along another path. By appropriately choosing its shape and dimensions, the frequencies of the resonance modes can have any required value, which opens up the possibility of transmitting a circular polarization wave by associating two modes having the same frequency and crossed linear polarizations. The coupling system takes the form of a microstrip line, but it is also stated to be coplanar, as in the Gegan U.S. Pat. No. 4,692,769 previously cited. The coupling system is provided with an impedance conversion system for matching it to the different input impedances of the line at the different resonant frequencies used as working frequencies.

A third prior art antenna differs from the previous two antennas in that it uses a single resonance path. It is described in U.S. Pat. No. 4,771,291 (LO et al.). Its patch includes point short circuits and slots extending along straight line segments inside the patch. The slots and short circuits reduce the difference between two frequencies corresponding to two resonances having said path in common but respective different modes, designated (0,1) and (0,3), i.e. the common path is occupied by one half-wave or by three half-waves, according to the mode concerned. The ratio between the two frequencies can therefore be reduced from 3 to 1.8. The point short circuits consist of conductors passing through the substrate. The coupling system is a coaxial line whose central conductor passes through the substrate of the antenna in order to be connected to its patch and whose earth conductor is connected to the earth layer of the antenna.

The above antenna has the particular disadvantage that its fabrication is complicated by the incorporation of point short circuits.

A fourth prior art two-frequency antenna differs from the previous three antennas in that it uses a quarter-wave resonance. It is described in IEEE ANTENNAS AND PROPAGATION SOCIETY INTERNATIONAL SYMPOSIUM DIGEST, NEWPORT BEACH, Jun. 18–23, 1995, pages 2124–2127 Boag et al. "Dual Band Cavity-Backed Quarter-wave Patch Antenna". A first resonant frequency is defined by the dimensions and characteristics of the substrate and the patch of the antenna. A resonance of substantially the same type is obtained on the same resonance path at a second frequency by using a matching system.

The coupling system appears to be of the coaxial line type, the matching system being placed at the end of the line, whose axial conductor is extended through the substrate of the antenna and connected to its patch.

Other prior antennas include three conductive layers, namely two superposed patches on top of a common earth layer. They then have the particular drawback that the cumulative thickness of the dielectric substrates between the layers makes the total thickness of the antenna excessive.

As a general rule, the above prior art antennas have the drawback that it is difficult, and therefore costly, to obtain the required resonant frequencies at the same time as good coupling of each resonance to a signal processor.

OBJECTS AND SUMMARY OF THE INVENTION

The objects of the present invention include:

providing a simple way of producing a two-frequency antenna with a coupling system whose impedance is easy to match at each of two resonant frequencies, and limiting the dimensions of the antenna.

With the above objects in view, the invention provides an antenna with a conductive layer and a coupling system which includes a coplanar line formed by two primary coupling slots in a conductive layer of said antenna. According to the invention, said coupling system further includes a slotted line formed by a slot connected to one of said two primary coupling slots and constituting a secondary coupling slot.

The antenna preferably includes a patch and an earth layer co-operating with said patch in the manner of the microstrip technology, and said coupling slots are formed in said patch. However, another possible arrangement is for a coupling system consisting of such slots to be formed in the earth layer of this kind of antenna.

Said patch preferably includes a separator system including at least one separator slot and defining two areas in said patch respectively constituting:

a primary resonance area including said coplanar line, and a secondary resonance area including said slotted line.

BRIEF DESCRIPTION OF THE DRAWINGS

Various aspects of the present invention will be better understood on reading the following description and the accompanying diagrammatic drawings. If the same item is shown in more than one figure, it is designated therein by the same reference numbers and/or letters.

MORE DETAILED DESCRIPTION

Figure 2:
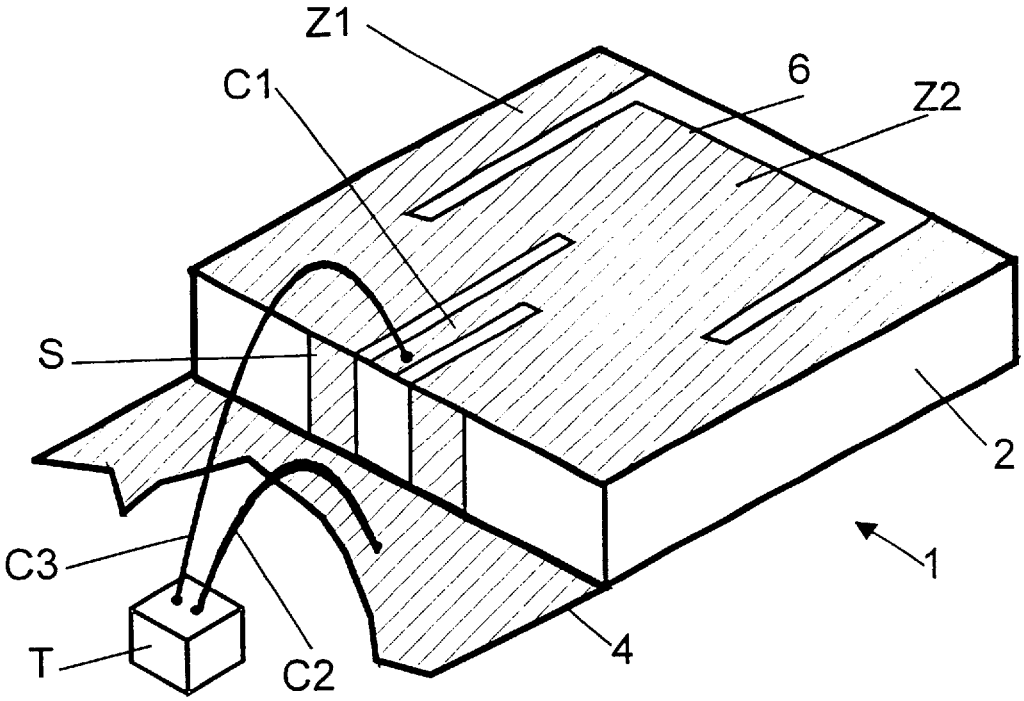
FIG. 2 is a simplified perspective view of a transmitter including an antenna whose patch is of the kind shown in FIG. 1.

As shown in FIG. 2, the resonant structure of an antenna in accordance with this invention includes the following components known in the art:

A dielectric substrate 2 having two mutually opposed principal surfaces respectively constituting a bottom surface and a top surface and extending in horizontal directions DL and DT, which directions can depend on the area of the antenna concerned. The substrate can have various shapes, as previously explained.

A bottom conductive layer extending over at least the whole of the bottom surface of the substrate, for example, and constituting an earth layer 4 of the antenna. FIG. 2 shows only a portion of this layer projecting beyond this bottom surface.

Figure 1:
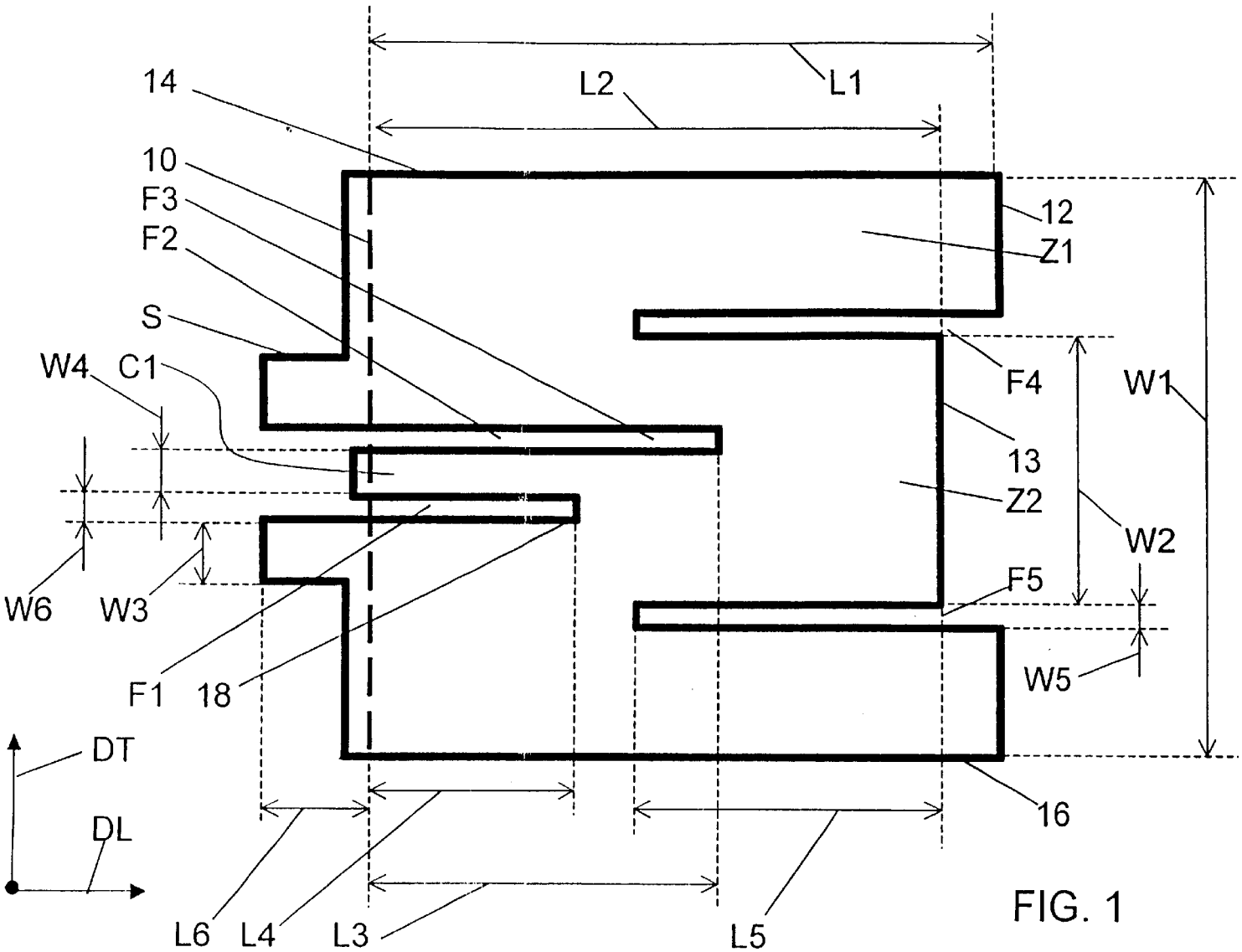
FIG. 1 shows a sheet of copper which has been cut and will subsequently be bent to shape to constitute the short circuit and the patch of an antenna constituting a first embodiment of this invention.
Figure 3:
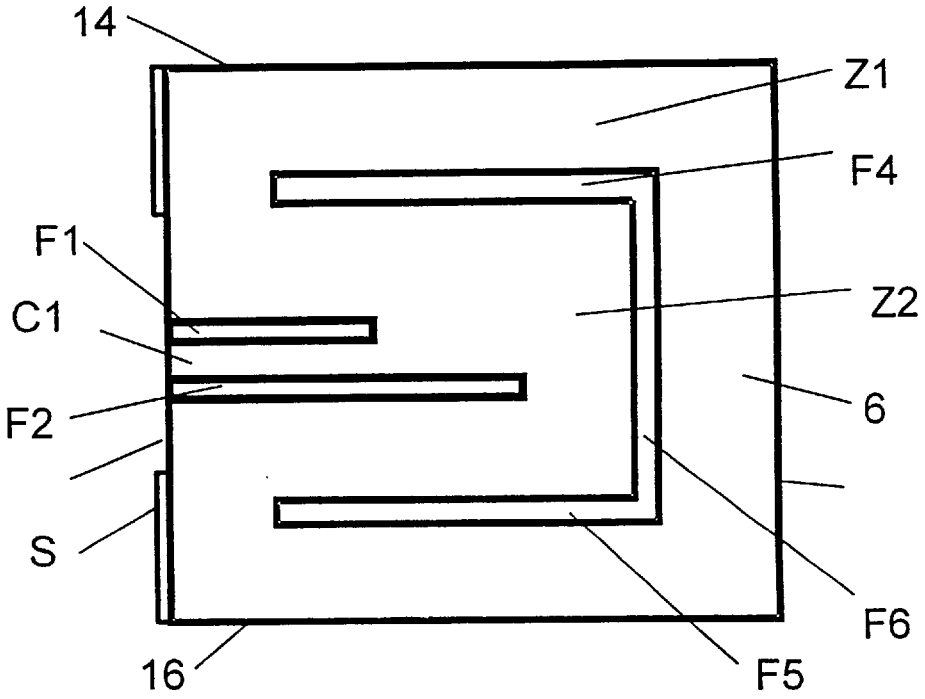
FIG. 3 is a plan view of an antenna constituting a second embodiment of the invention.

A top conductive surface shown in FIGS. 1 to 3 and extending over an area of the top surface of the substrate above the earth layer 4 to constitute a patch 6. As a general rule the patch has a length and a width respectively extending in a horizontal longitudinal direction DL and a horizontal transverse direction DT, and its periphery can be considered as consisting of four edges extending in pairs more or less in those two directions. Although the words "length" and "width" usually apply to two mutually perpendicular dimensions of a rectangular object, the length being greater than the width, it must be understood that the patch 6 can depart considerably from a rectangular shape without departing from the scope of the invention. One of the edges extends generally in the transverse direction DT and constitutes a rear. edge including two segments 10 and 11. A front edge 12 is opposite the rear edge. Two lateral edges 14 and 16 join the rear edge to the front edge.

Finally, a short circuit S extending from the segment 10 of the rear edge of the patch and electrically connecting the patch 6 to the earth layer 4. The short circuit is formed by a conductive layer extending over an edge surface of the substrate 2, which surface is typically plane and then constitutes a short circuit plane. However, the short circuit could instead consist of one or more discrete components connected in parallel between the earth layer 4 and the patch 6. In each of the above embodiments, for at least one resonance of the antenna, an at least virtual quarter-wave electric field node is imposed in the vicinity of the segment 10. This kind of resonance and its frequency are referred to hereinafter as the "primary resonance" and the "primary frequency". Said rear, front and lateral edges and the longitudinal and transverse directions are defined by the position of this short circuit, provided that the impedance of the short circuit is sufficiently low to impose on the antenna a resonance having this kind of electric field node.

The antenna further includes a coupling system which is part of a connection system that connects the resonant structure of the antenna to a signal processor T, for example for that processor to excite one or more resonances of the antenna if the antenna is a transmit antenna. In addition to this system, the connection system typically includes a connecting line external to the antenna. The connecting line can be a coaxial line, a microstrip line or a coplanar line. In FIG. 2 it is symbolized by two conductive wires C2 and C3 respectively connecting the earth layer 4 and the strip C1 to the two terminals of the signal processor T. However, it must be understood that in practice the connecting line would preferably take the form of a microstrip line or a coaxial line.

The signal processor T is adapted to operate at predetermined working frequencies which are at least close to the usable resonant frequencies of the antenna, i.e. in pass-bands centered on those resonant frequencies. It can be a composite device, in which case it includes a component permanently tuned to each of the working frequencies. It can also include a component that can be tuned to the various working frequencies. Said primary resonant frequency constitutes one such usable resonant frequency.

In the context of the present invention, the coupling system of the antenna is a composite system: it includes, firstly, a primary coupling line formed by two slots in the patch 6 constituting primary coupling slots F1 and F2 and, secondly, a secondary coupling line formed by another slot F3 which is connected to one of the two primary coupling slots, for example the slot F2, and which constitutes a secondary coupling slot. For example, although this is not necessary in the context of this invention, the widths of the coupling slots are uniform, their paths are linear, and the secondary coupling slot is aligned with the primary coupling slot to which it is connected.

These widths and the thickness and the permittivity of the substrate are such that the primary and secondary coupling lines respectively constitute a coplanar line and a slotted line as previously described.

As shown here, the patch 16 preferably includes a separator system including a separator slot like the slot F4 or F5 and defining in the patch two areas respectively constituting:

a primary resonance area Z1 including said coplanar line F1, F2, and a secondary resonance area Z2 including said slotted line F3.

The short circuit S then enables at least the quarter-wave primary resonance to be established in its area with an at least virtual electric field node fixed by the short circuit and a resonance path extending from the rear edge 10 toward the front edge 12, the edges of this area including the lateral edges 14 and 16. The secondary resonance area Z2 extends in the longitudinal direction at a distance from the rear edge 10 and in the transverse direction over a middle part of the width W1 of the patch, at a distance from each of the two lateral edges 14 and 16. The coupling slots F1 and F2 forming the coplanar line extend in the longitudinal direction from the rear edge.

In this example, the slotted line F3 extends in the longitudinal direction so that the secondary resonance is of the half-wave type with a resonance path extending in the transverse direction. However, it could be bent at right angles and the secondary resonance could be of the quarter-wave type with a longitudinal resonance path as the primary resonance. The difference between the primary and secondary frequencies would then result from the difference between the longitudinal dimensions of the two areas, in other words, the short circuit being common, the difference between the longitudinal positions of the respective front edges of the two areas.

In the first embodiment of the invention, the separator system includes two separator slots F4 and F5 in the patch 6 extending in the longitudinal direction DL from the front edge 12 of the patch, so that two lateral edges of the secondary resonance area Z2 consist of respective edges of the two slots and a front edge of the area consists of a segment 13 of the front edge between the two slots.

As shown in FIG. 1, a copper sheet constituting the patch 6 has an extension toward the front beyond a line that is intended to constitute the rear edge 10 of the patch. During fabrication of the antenna it is bent about this line along the rear edge of the substrate so that the extension is pressed onto the vertical edge of the substrate. Part of the extension is connected to the substrate to constitute the short circuit S. The short circuit is in a middle segment of this edge and is in two parts on respective opposite sides of the coupling system C1, F1, F2. The other parts of the extension are not shown in FIG. 2. They facilitate positioning the patch on the substrate and the one that extends the strip C1 is used to connect the strip to the processor T without encroaching on the top surface of the antenna.

Various compositions and values are indicated hereinafter by way of example for this first embodiment. The lengths and widths of the substrate and the patch are respectively indicated in the longitudinal direction DL and in the transverse direction DT.

primary resonant frequency: F1=940 MHz, secondary resonant frequency: F2=1 880 MHz, input impedance: 50 ohms, pass-bandwidths centered on primary and secondary frequencies: 2.5% and 2% of those frequencies, respectively, as measured with a standing wave ratio less than or equal to 3.5, composition of substrate: laminate based on fluoropolymers such as PTFE having a relative permittivity $\epsilon r=5$ and a dissipation factor tan d=0.002, length and width of substrate: equal to those of patch in primary resonance area Z1, thickness of substrate: L6=3 mm, thickness of copper sheets forming conductive layers: 17 $\mu$m, length of patch in primary resonance area Z1: L1=28.75 mm, length of patch in secondary resonance area Z2: L2=27.25 mm, width of patch: W1=25 mm, width of secondary resonance area Z2: W2=12.5 mm, length of coupling slot F1: L4=13 mm, total length of coupling slots F2 and F3: L3=23 mm, width of coupling slots F1, F2 and F3: W6=0.4 mm, width of conductor C1: W4=4.75 mm, length of separator slots F4 and F5 in area Z2: L5=18 mm, width of separator slots F4, F5 and F6: W5=1 mm, and width of each of two parts of short circuit: W3=1 mm.

In a second embodiment of the invention, shown in FIG. 3, the separator system includes a U-shaped separator slot at a distance from the edges of the patch 6. The slot has two branches F4 and F5 connected together by a base F6. The two branches extend in the longitudinal direction, facing and spaced from the lateral edges 14 and 16, respectively, and the base extends in the transverse direction, facing and spaced from the front edge 12.

It is assumed that these two embodiments of the antenna operate in the following manner.

The coupling between firstly the standing wave of each of the two primary and secondary resonances and secondly the waves radiated in space occurs principally at one or more edges of the patch 6 or the separator slots F4, F5 and F6, or through the slots. This kind of edge or slot could therefore be called a primary or secondary radiating edge or slot, depending on the resonance concerned.

In both embodiments of the invention there is a single primary radiating edge, namely the front edge 12, which corresponds to a quarter-wave primary resonance having an electric field node in the segment 10. In the first embodiment two secondary radiating edges are formed by the edges of the separator slots F4 and F5 at the boundary of the area Z2 in the vicinity of the front edge 13. In the second embodiment the two secondary radiating slots are the slots F4 and F5, primarily at a distance from their rear end, and the slot F6 forms an additional secondary radiating slot, in the vicinity of its ends.

What is claimed is:

1. An antenna with a conductive layer and a coupling system which includes a coplanar line formed by two primary coupling slots in a conductive layer of said antenna, wherein said coupling system further includes a slotted line formed by a slot connected to one of said two primary coupling slots and constituting a secondary coupling slot.

2. The antenna according to claim 1, including a patch and an earth layer co-operating with said patch in accordance with the microstrip technology, and wherein said coupling slots extend in said patch.

3. The antenna according to claim 2, wherein said patch includes a separator system including at least one separator slot and defining two areas in said patch respectively constituting:

a primary resonance area including said coplanar line, and a secondary resonance area including said slotted line.

4. A two-band transmitter including:

a signal processor adapted to be connected at frequencies in two working bands centered on two respective predetermined center frequencies to send and/or receive an electrical signal in each of said two bands, and an antenna including a plurality of superposed conductive layers to constitute at least one resonant structure and a coupling system and being adapted to be connected to said processor via said coupling system to couple said electrical signal to radiated waves, wherein said coupling system includes a coplanar line formed by two slots facing each other in one of said conductive layers and respectively constituting two coupling slots, said coplanar line couples a resonance of said antenna to said electrical signal, said resonance constitutes a primary resonance and has a primary frequency substantially equal to one of said two center frequencies, and another resonance of said antenna constitutes a secondary resonance having a secondary frequency substantially equal to the other of said two center frequencies, wherein said coupling system further includes a slotted line which is formed by a slot connected to one of said two primary coupling lines and constituting a secondary coupling slot and which couples said secondary resonance to said electrical signal.

5. The transmitter according to claim 4, wherein said antenna includes:

a dielectric substrate having two mutually opposed principal surfaces extending in horizontal directions of said antenna and respectively constituting a bottom surface and a top surface, a bottom conductive layer extending over said bottom surface and constituting an earth layer of said antenna, and a top conductive layer extending over an area of said top surface above said earth layer to constitute a patch cooperating with said earth layer in accordance with the microstrip technology, wherein said coupling slots are in said patch.

6. The transmitter according to claim 5, wherein said patch includes a separator system including at least one separator slot and defining in said patch two areas respectively constituting:

a primary resonance area including said coplanar line, and a secondary resonance area including said slotted line.

7. The transmitter according to claim 6, wherein said patch has an edge provided with a short circuit electrically connecting said patch to said earth layer, said edge extends in one of said horizontal directions constituting a transverse direction and constitutes a rear edge, said patch also has a front edge opposite said rear edge and two lateral edges joining said rear edge to said front edge and respectively constituting two lateral edges, a length of said patch extends between said rear edge and said front edge in a longitudinal direction which is another of said horizontal directions, a width of said patch extends between said two lateral edges, said short circuit enables said quarter-wave primary resonance to be established in said primary resonance area with an at least virtual electric field node fixed by short circuit and a resonance path extending from said rear edge towards said front edge, edges of said areas include said two lateral edges, said secondary resonance area extends in said longitudinal direction at a distance from the rear edge and extends in said transverse direction over a middle part of said width of the patch at a distance from each of said two lateral edges, and said two coupling slots form said coplanar line by extending in said longitudinal direction from said rear edge.

8. The transmitter according to claim 7, wherein said slotted line extends in said longitudinal direction so that said secondary resonance is a half-wave resonance having a resonance path extending in said transverse direction.

9. The transmitter according to claim 8, wherein said separator system includes two separator slots in said patch extending in said longitudinal direction from said front edge of said patch so that two lateral edges of said secondary resonance area are formed by respective edges of said two slots and a front edge of said area is formed by a segment of said front edge of the patch between said two slots.

10. The transmitter according to claim 8, wherein said separator system includes a U-shaped separator slot at a distance from said edges of the patch and having two branches which are connected together by a base and extend in said longitudinal direction, facing and at a distance from respective lateral edges, and said base extends in said transverse direction, facing and spaced from said front edge.

11. An antenna coupling system comprising:

two primary coupling slot mans for coupling a coplanar line, said two primary coupling slot means forming said coplanar line in a conductive layer of said antenna coupling system; and secondary coupling slot means for coupling said coplanar line, said secondary coupling slot means being connected to one of said two primary coupling slot means to produce a secondary resonance.

12. The antenna coupling system of claim 11, further comprising a microstrip technology patch and earth layer, wherein said coupling slot means extend in said patch.

* * * * *